US008579640B2

(12) United States Patent
Ho

(10) Patent No.: US 8,579,640 B2
(45) Date of Patent: Nov. 12, 2013

(54) ELECTRICAL CONNECTOR DEVICE

(75) Inventor: Yi-Tse Ho, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/369,989

(22) Filed: Feb. 9, 2012

(65) Prior Publication Data

US 2012/0202366 A1 Aug. 9, 2012

(30) Foreign Application Priority Data

Feb. 9, 2011 (TW) ..... 100202509 U
Feb. 9, 2011 (TW) ..... 100202510 U

(51) Int. Cl.
*H01R 13/62* (2006.01)

(52) U.S. Cl.
USPC ..... 439/159

(58) Field of Classification Search
USPC ..... 439/159, 630, 946, 862; 455/558; 361/737, 679.32
See application file for complete search history.

(56) References Cited

U.S. PATENT DOCUMENTS 4,190,306 A * 2/1980 Litchfield et al. ..... 312/348.2
5,315,478 A * 5/1994 Cadwell et al. ..... 361/679.32
5,769,646 A * 6/1998 Cavello et al. ..... 439/136
6,101,372 A * 8/2000 Kubo ..... 455/558
6,135,809 A * 10/2000 Asakawa ..... 439/489
6,261,113 B1 * 7/2001 Chen ..... 439/260
6,261,128 B1 * 7/2001 Heim et al. ..... 439/630
6,568,960 B2 * 5/2003 Bricaud et al. ..... 439/630
6,580,923 B1 * 6/2003 Kubo ..... 455/558
6,602,096 B1 * 8/2003 Kronestedt et al. ..... 439/630
7,066,748 B2 * 6/2006 Bricaud et al. ..... 439/159
7,081,020 B1 * 7/2006 Lee ..... 439/630
7,112,075 B1 * 9/2006 Su ..... 439/159
7,125,258 B2 * 10/2006 Nakakubo et al. ..... 439/64
7,357,678 B1 * 4/2008 Lee et al. ..... 439/630
7,980,876 B2 * 7/2011 Bombale et al. ..... 439/301
8,061,608 B2 * 11/2011 Liao et al. ..... 235/439
8,270,175 B2 * 9/2012 Duan et al. ..... 361/737
8,308,514 B1 * 11/2012 Su et al. ..... 439/630

* cited by examiner

*Primary Examiner* — Alexander Gilman
(74) *Attorney, Agent, or Firm* — Stephen L. Sheldon

(57) ABSTRACT

An electrical connection device comprises an electrical connector and a carriage. The electrical connector comprises a housing, a cage, and a plurality of terminals. The housing has a body, the terminals are provided in the body. The cage encloses the housing, and defines, together with the housing, an insertion slot, and an opening of the insertion slot corresponds to a front end of the body. The carriage can be slidably positioned in the insertion slot. The housing comprises at least a clamping slot provided close to the front end in the body, the carriage has a clamping block mating with the clamping slot, the carriage is releasably held to the electrical connector by clampingly connecting the clamping slot to the clamping block.

11 Claims, 9 Drawing Sheets

ELECTRICAL CONNECTOR DEVICE

RELATED APPLICATIONS

This application claims priority to Taiwanese Application No. 100202509, filed Feb. 9, 2011, and to Taiwanese Application No. 100202510, filed Feb. 9, 2011, both of which are incorporated herein by reference in their entirety.

TECHNICAL FIELD

The present invention relates to an electrical connection device, and more specifically, to an electrical connection device for an electronic card.

BACKGROUND OF THE PRESENT INVENTION

Currently, there has been an electrical connector for electrically connecting to an electronic card, such as a card connector disclosed by a Taiwan utility model patent publication No. M384424, wherein a switch terminal has a flake-like holding portion, a right edge of the holding portion foldedly extends rightwards to form a soldering portion, a rear edge of the holding portion inclinedly extends rearwards and upwards to form a resilient portion, a distal end of the resilient portion foldedly extends to from a first contact portion, the holding portion is held on an insulating body, the resilient portion is accommodated in an accommodating groove, the first contact portion is resiliently inserted into a card inserting space, the soldering portion is accommodated in a slot for being soldered on a circuit board.

Since the contact portion of the switch terminal (which can be referred to as a detecting terminal) disclosed in the above patent is resiliently inserted into the card inserting space, when an electronic card is inserted into the card inserting space, the electronic card may scrape the contact portion of the switch terminal, and therefore it is easy to result in one or more of the following problems. First, plastics of the electronic card can be scraped off by the contact portion of the switch terminal and adhered to the contact portion, so that a surface of the contact portion is partly covered by the plastics, which makes conductivity poor. Second, the surface of the contact portion of certain switch terminal is plated with good conductive metal, such as gold, so as to enhance conductivity. However, the gold-plating layer is easily stripped off and damaged after the surface of the contact portion of the switch terminal is scraped by the electronic card, thereby making conductivity poor.

In addition to the above, another electrical connection device for electrically connecting to an electronic card is an electrical connection device disclosed by Taiwan utility model patent publication No. M312830, which comprises an electrical connector and a positioning rack carrying an electronic card. The electronic card is positioned via the positioning rack, and then the positioning rack along with the electronic card is inserted into an insertion slot of the electrical connector, by which the electronic card and the electrical connector is electrically connected.

In order to make the positioning rack held on the electrical connector, in the foregoing patent, registration convex portions provided in two side edges of the positioning rack are mated with registration holes provided in side walls of a seat body at two sides of insertion slots of the electrical connector, by which the positioning rack is held. However, because the registration holes are provided in the side walls of the seat body, the strength of the side walls is reduced and the side walls are susceptible to damage. Furthermore, if thicknesses of the side walls was increased to maintain strength, a width of the seat body would be increased. Therefore, there is room for improvement in how to get the positioning rack and the electrical connector clamped and held under a while ensuring that the strength of the seat body is not damaged and the volume of the electrical connector is not increased.

Thus, certain individuals would appreciate improvements in the design of card connectors.

SUMMARY OF THE PRESENT INVENTION

In an embodiment an electrical connector includes a housing provided with a baffle wall, a cage, and a plurality of signal terminals and a detecting terminal provided in the body of the housing. The cage encloses the housing, and defines, together with the housing, a card inserting space in front of the baffle wall and a rearward extending space located behind the baffle wall and communicated with the card inserting space. The detecting terminal has a first fixing portion, a first resilient arm portion, a first contact portion, and a first soldering portion. The first fixing portion is located in front of the baffle wall, a first resilient arm portion extends rearwards and upwards from the first fixing portion toward the rearward extending space and a distal end of the first resilient arm portion is connected to a first contact portion, the first contact portion is located in the rearward extending space behind the baffle wall and contacts the cage, the first soldering portion extends out of the housing from the first fixing portion.

In another embodiment an electrical connection device comprises an electrical connector and a carriage. The electrical connector comprises a housing, a cage, and a plurality of terminals. The housing has a body, the terminals are provided in the body. The cage is sheathed on the housing, and defines, together with the housing, an insertion slot, and an opening of the insertion slot corresponds to a front end of the body. The carriage is slide-connected to the insertion slot. The housing further comprises at least a clamping slot provided close to the front end in the body, the carriage has a clamping block mating with the clamping slot, the carriage is releasably held to the electrical connector by clampingly connecting the clamping slot to the clamping block.

In another embodiment an electrical connection device comprises an electrical connector and a carriage. The electrical connector comprises a housing, a cage, and a plurality of terminals provided in the housing. The cage is sheathed on the housing and defines, together with the housing, an insertion slot, and the cage comprises a base wall and two opposite side walls, and an opening of the insertion slot corresponds to a front end of the base wall. The carriage is slide-connected to the insertion slot. The cage further comprises at least a clamping hole provided close to the front end in the base wall, and the carriage has a clamping block mating with the clamping hole, the clamping block has two guiding surfaces respectively located at two opposite sides along a slide-connecting direction. The carriage is releasably held to the electrical connector by clampingly connecting the clamping hole to the clamping block.

DESCRIPTION OF THE PREFERRED EMBODIMENTS

Figure 1:
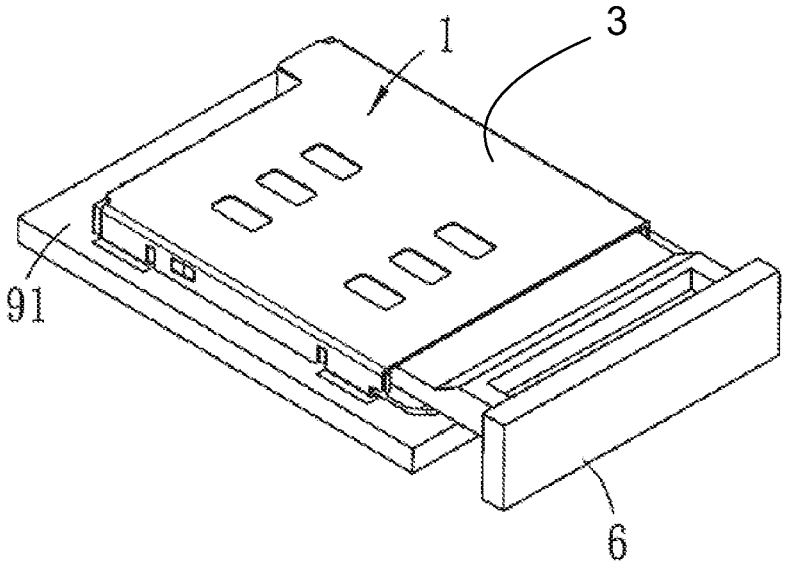
FIG. 1 is a perspective view of an embodiment that illustrates an assembly relationship among an electrical connection device, an electronic card, and a circuit board.

The foregoing and other technical contents, features and effects relating to the following disclosure will be illustrated through the following detailed description. The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity. Before the embodiments are described in details, it should be noted that like reference numerals indentify like elements in the following description.

Figure 2:
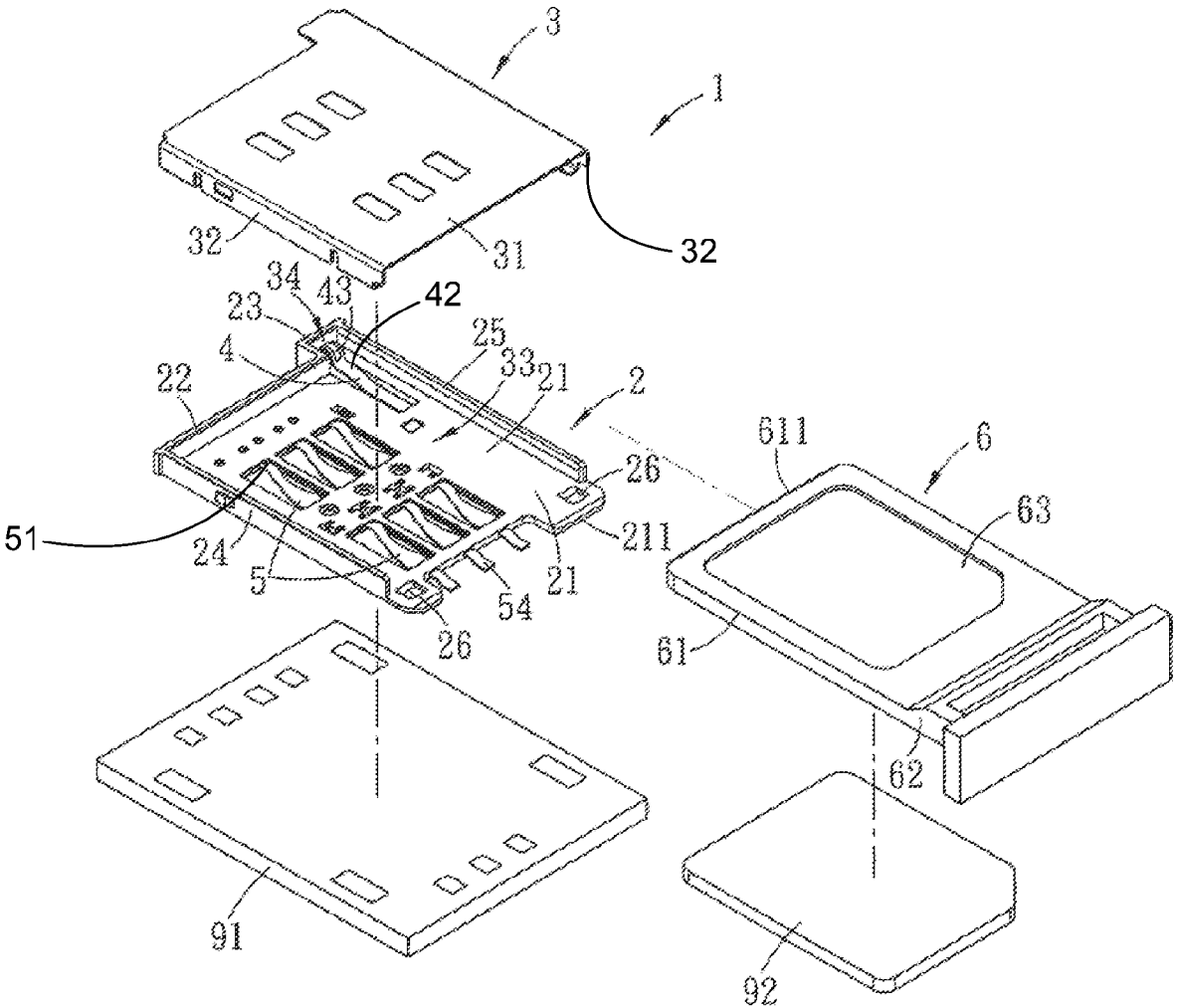
FIG. 2 is an exploded perspective view of FIG. 1.
Figure 3:
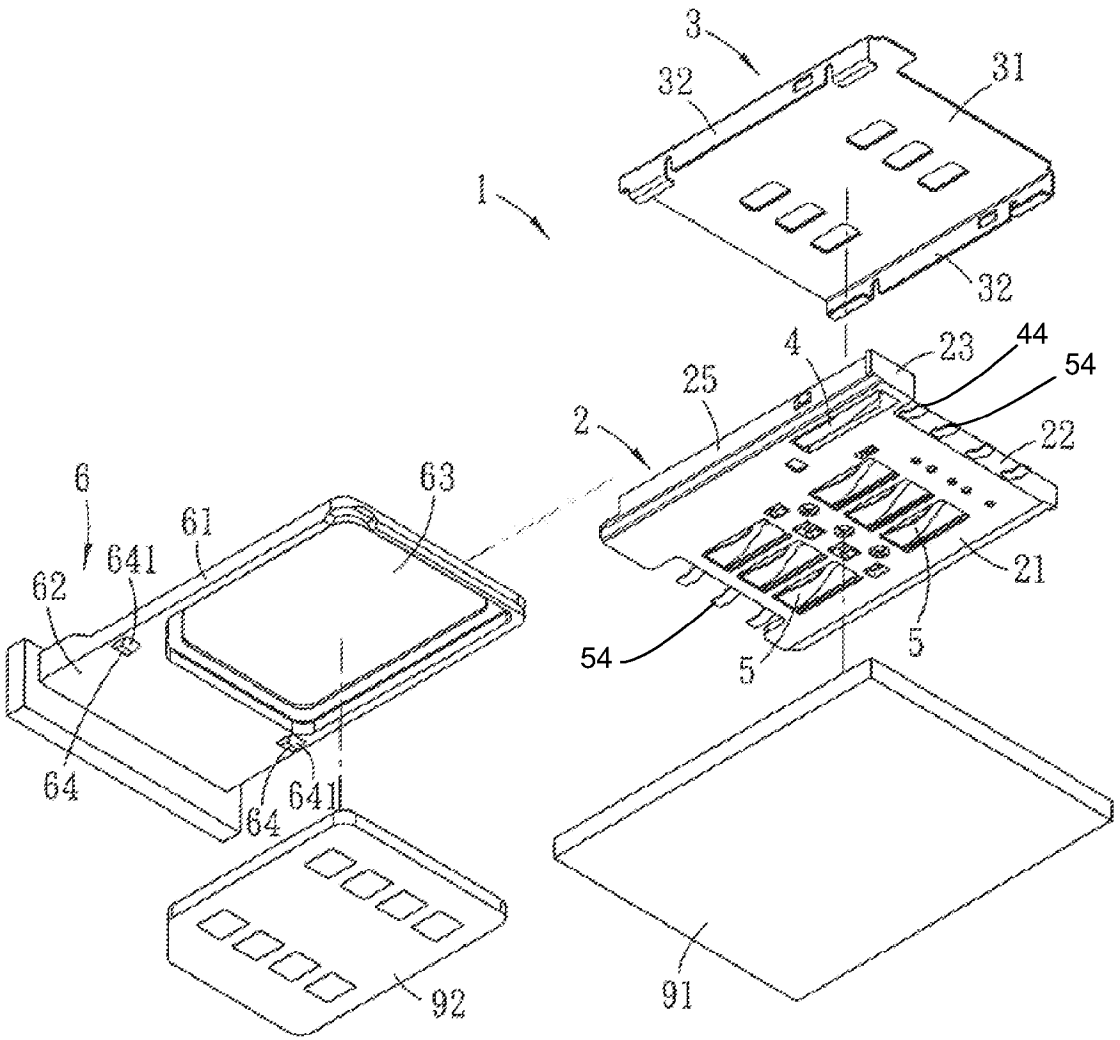
FIG. 3 is a view of FIG. 2 viewed from another angle.
Figure 4:
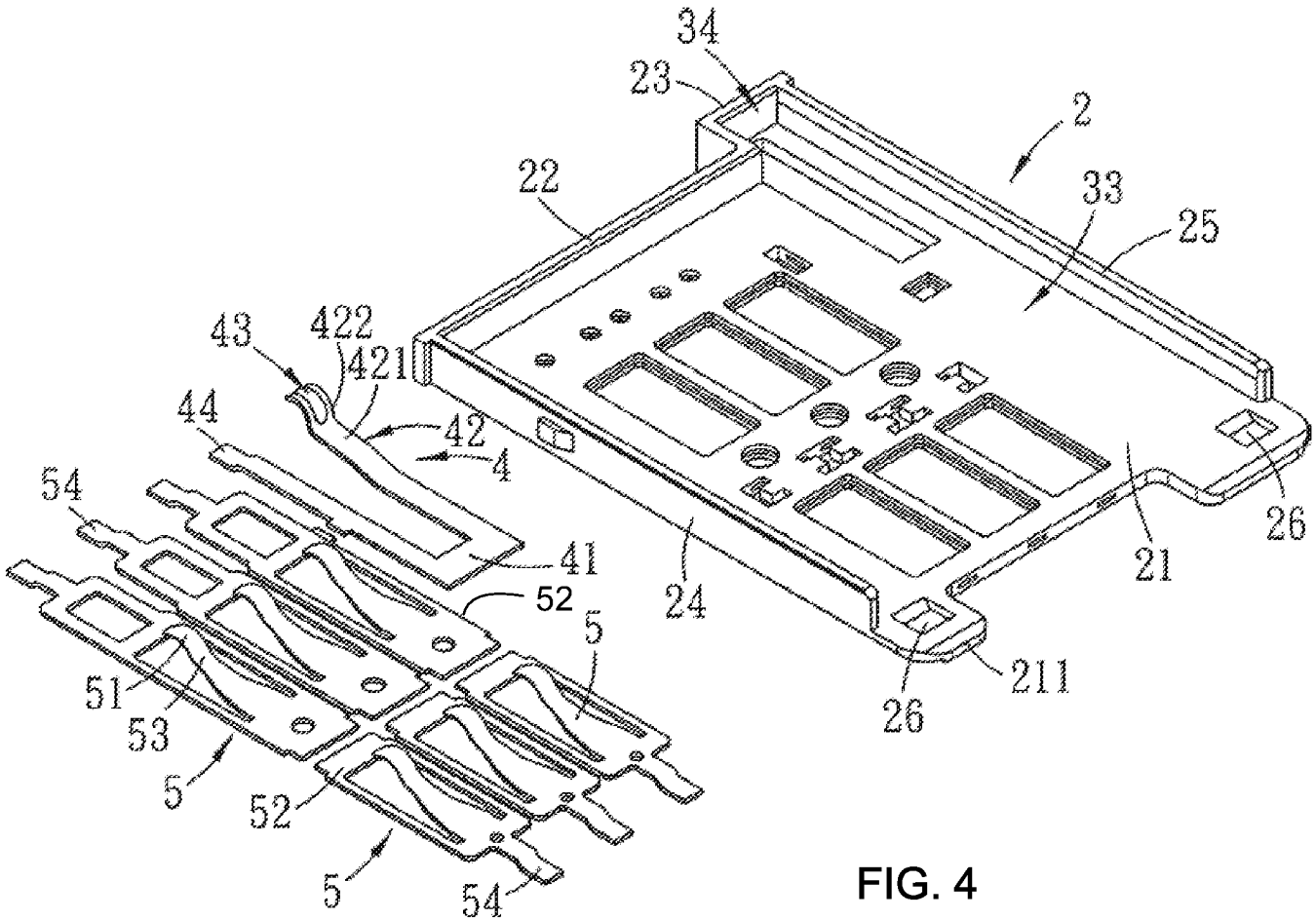
FIG. 4 is an exploded perspective view of an embodiment of an electrical connection device of that illustrates a housing, a detecting terminal, and a plurality of signal terminals.
Figure 5:
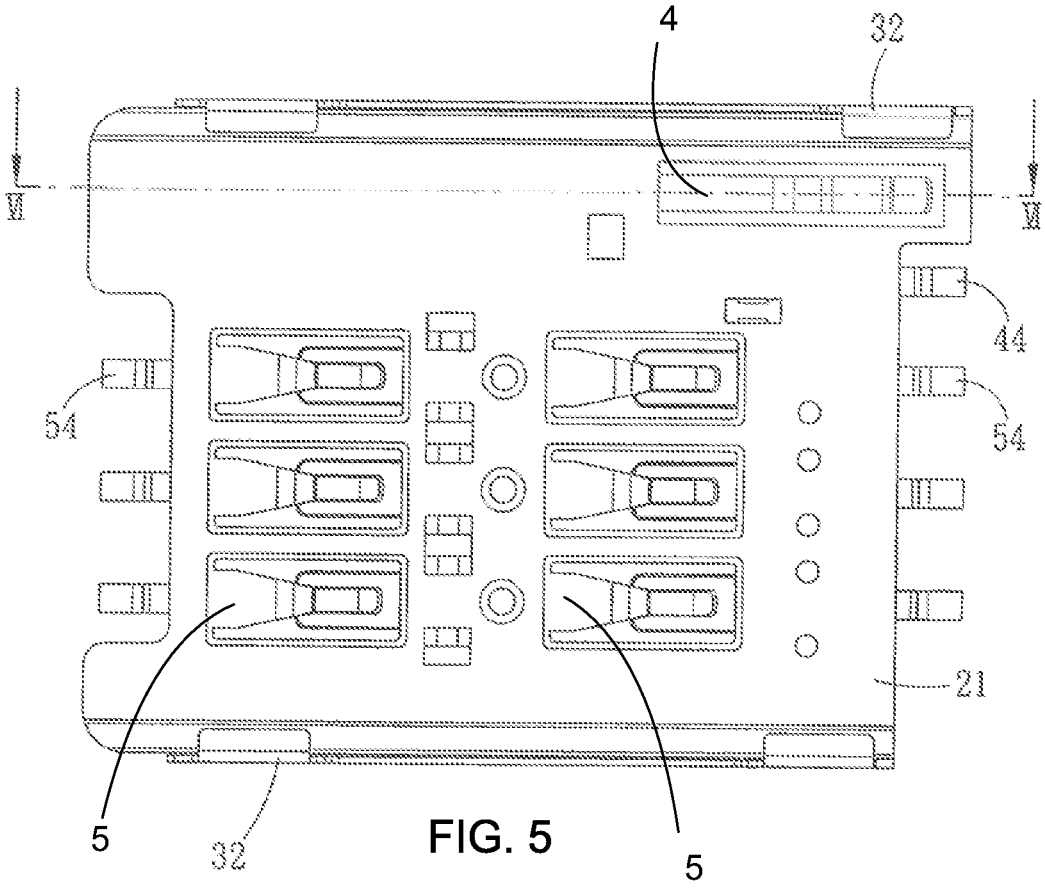
FIG. 5 is a bottom view of the embodiment depicted in FIG. 4.
Figure 6:
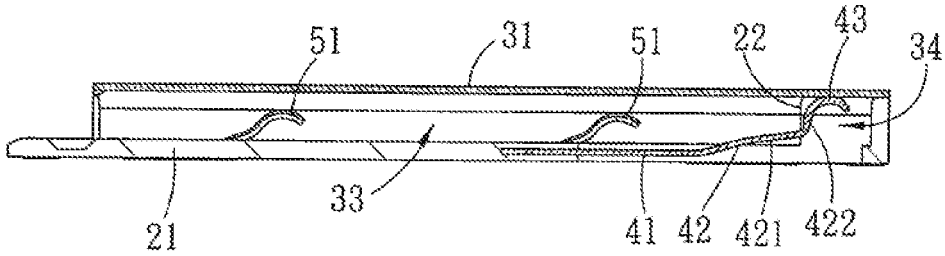
FIG. 6 is a sectional view along a VI-VI line of FIG. 5.

Referring to FIG. 1, FIG. 2, and FIG. 3, an electrical connection device according to an embodiment includes an electrical connector 1 and a carriage 6. The electrical connector 1 is soldered on a circuit board 91, the carriage 6 is used to carry an electronic card 92 and electrically connect the electronic card 92 to the electrical connector 1 and in turn to electrically connect the electronic card 92 and the circuit board 91. In an embodiment, the electronic card 92 can be a SIM (Subscriber Identity Module) card. The electrical connector 1 may be mounted on an upper surface or a lower surface of the circuit board 91.

The electrical connector 1 includes a housing 2 (which may be formed of an insulative material), a cage 3 (which may be formed of a metal material), and a plurality of terminals 4, 5. One of the plurality of terminals can be a detecting terminal 4, the other can be signal terminals 5.

The housing 2 has a body 21, a baffle wall 22, an extending wall 23, and two side walls 24, 25. A rear side edge of the body 21 is integrally connected with the baffle wall 22 and the extending wall 23. The extending wall 23 is connected to one end of the baffle wall 22 and projectedly extends rearwards in form of L-shape. The two side walls 24, 25 are respectively connected to two opposite sides of the body 21 along a card inserting direction, and a rear end of the side wall 24 of the side walls 24, 25 is connected to the baffle wall 22, a rear end of the side wall 25 of the side walls 24, 25 is connected to the extending wall 23.

The cage 3 can enclose the housing 2 and has a base wall 31 and two side walls 32 respectively connected to two opposite sides of the base wall 31 and respectively mated with and sheathed on the two side walls 24, 25 of the housing 2. The cage 3 defines, together with the housing 2, an insertion slot 33 in front of the baffle wall 22 and a rearward extending space 34 behind the baffle wall 22 and communicated with the insertion slot 33. In this embodiment, the rearward extending space 34, namely, a space projectedly extending rearwards with respect to the baffle wall 22 is together formed by the extending wall 23, the body 21, and the cage 3. Of course, the rearward extending space 34 may be formed by using at least one of the extending wall 23, the body 21, the cage 3, and the side wall 25, and the extending wall 22 may be also adjusted for a shape thereof or may be omitted according to the practical design requirement. A position of an opening of the insertion slot 33 corresponds to a front end 211 of the body 21 of the housing 2.

Referring to FIG. 2, FIG. 4, FIG. 5, and FIG. 6, the detecting terminal 4 is provided in the body 21 of the housing 2, has a first fixing portion 41, a first resilient arm portion 42, a first contact portion 43, and a first soldering portion 44. The first fixing portion 41 is located in front of the baffle wall 22, namely, is located at the insertion slot 33. The first resilient arm portion 42 extends rearwards and upwards from the first fixing portion 41 toward the rearward extending space 34, and a distal end of the first resilient arm portion 42 is connected to the first contact portion 43. Specifically, the first resilient arm portion 42 has a slow ascending segment 421 and a steep ascending segment 422 which are connected, the slow ascending segment 421 is connected to the first fixing portion 41, the steep ascending segment 422 is located behind the baffle wall 22 and connected to the first contact portion 43. The first contact portion 43 is located in the rearward extending space 34 behind the baffle wall 22 and contacts the base wall 31 of the cage 3. The first soldering portion 44 extends out of the housing 2 from the first fixing portion 41, so as to be soldered on the circuit board 91.

The plurality of signal terminals 5 are provided in the body 21 of the housing 2, respectively have a second contact portion 51 located in the insertion slot 33, a second fixing portion 52, a second resilient arm portion 53, and a second soldering portion 54. The second fixing portion 52 is located in front of the baffle wall 22, namely, is located in the insertion slot 33. The second resilient arm portion 53 extends from the second fixing portion 52, and a distal end of the second resilient arm portion 53 is connected to the second contact portion 51. The second soldering portion 54 extends out of the housing 2 from the second fixing portion 52, so as to be soldered on the circuit board 91.

The detecting terminal 4 and the signal terminals 5 can be integrated with the housing 2 by way of insert-molding. This allows for a more compact housing design and potentially simplifies manufacturing.

Referring to FIG. 1, FIG. 2, and FIG. 3 again, the housing 2 further comprises at least a clamping slot 26 provided close to a front end 211 in the body 21, in this embodiment, the housing 2 comprises two clamping slots 26 which are respectively provided at two sides close to the front end 211 in the body 21 and are also respectively located at two sides of the second soldering portion 54 of the signal terminals 5 in a front row, e.g., a region that the body 21 extends correspondingly to a length of the second soldering portion 54. Therefore, the volume of the electrical connector 1 does need to be increased and the strength of the housing 2 can be undamaged.

Figure 7:
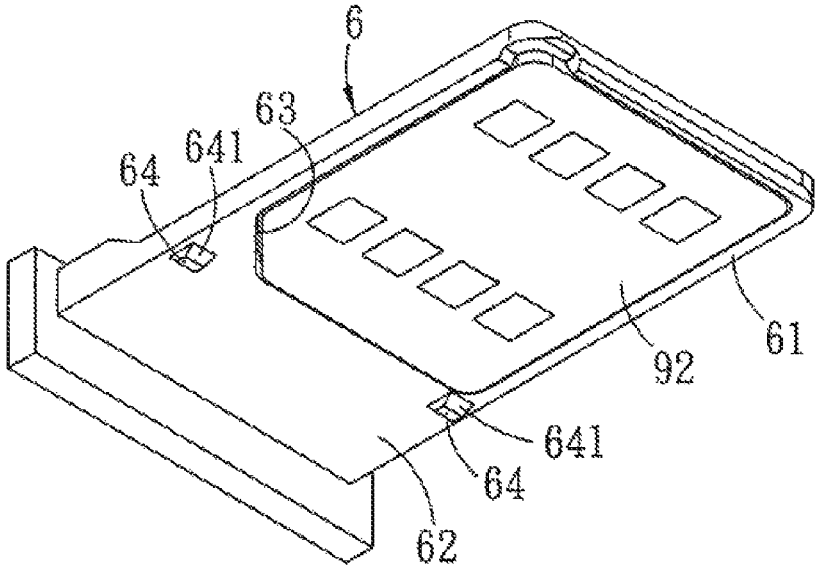
FIG. 7 is a perspective view of an embodiment of an assembly of a carriage and the electronic card.
Figure 8:
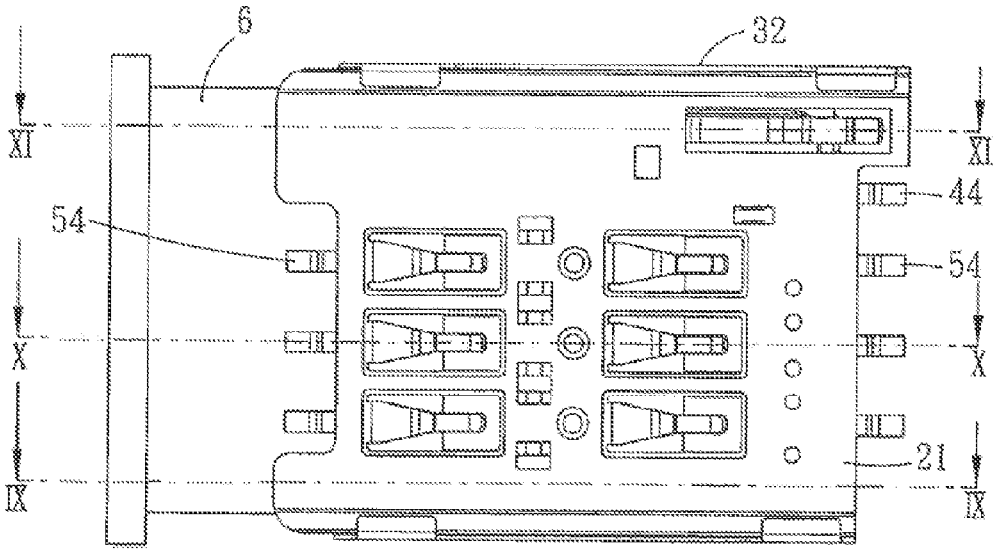
FIG. 8 is a bottom view of FIG. 1 with the circuit board is removed.
Figure 9:
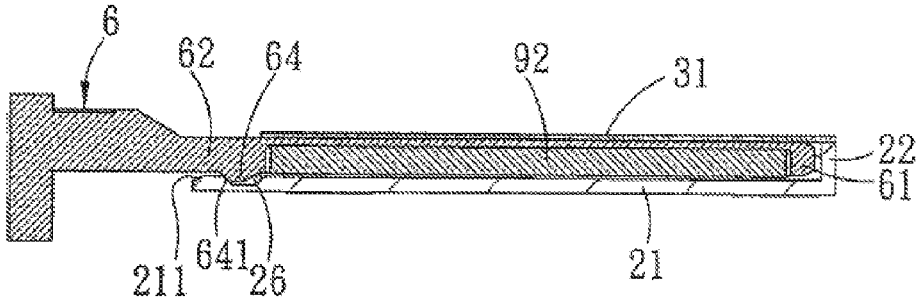
FIG. 9 is a sectional view along an IX-IX line of FIG. 8.
Figure 10:
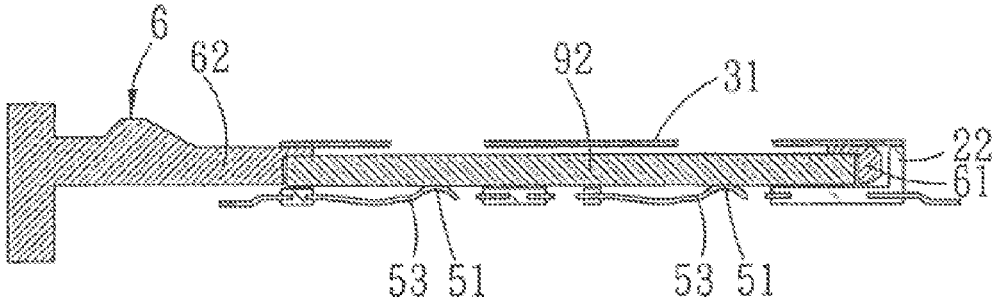
FIG. 10 is a sectional view along a X-X line of FIG. 8.

Referring to FIGS. 1-3 again, the housing 2 further has two clamping slots 26 provided close to a front end 211 in the body 21 and the carriage 6 has a carrying portion 61, a clamping connection portion 62, an accommodating groove 63, and two clamping blocks 64 respectively mating with respective clamping slots 26. The accommodating groove 63 is provided in the carrying portion 61 and has a shape mating with the electronic card 92 so as to accommodate the electronic card 92. The clamping blocks 64 are provided in the clamping connection portion 62, and respectively have two guiding surfaces 641 located in two opposite sides along a slide-connecting direction. As shown in FIG. 7, the electronic card 92 may be assembled in the accommodating groove 63 of the carriage 6. Referring to FIG. 8, FIG. 9, and FIG. 10, the carriage 6 may be slide-connected to the insertion slot 33, by inserting the carrying portion 61 into the insertion slot 33 and clampingly connecting the clamping blocks 64 to the clamping slots 26 of the housing 2 each other, the electronic card 92 is electrically connected to the terminals (the signal terminals 5) of the electrical connector 1 and the carriage 6 may be releasable held to the electrical connector 1, therefore making an electrical connection between the electronic card 92 and the electrical connector 1 more stable. If the carriage 6 will be withdrawn, an operator may pull outwards a part of the carriage 6 exposed outside the electrical connector 1, that is to say, using the guiding surfaces 641 of the clamping blocks 64, the clamping blocks 64 may be easily disengaged with the clamping slots 26, and clamping connection and disengagement may be completed without using resilience of the cage 3. Of course, the operator may also pull upwards the part of the carriage 6 exposed outside the electrical connector 1, that is to say, using resilience of the cage 3, the clamping blocks 64 may be disengaged with the clamping slots 26, thereby easily withdrawing the carriage 6. In addition, because the clamping slots 26 are adjacent to the opening of the insertion slot 33, a scraping distance between the carriage 6 and the housing 2 may become shortest, so as to reduce wear between them.

Similarly, in an embodiment that the carriage 93 is not used, such as when the electronic card 92 is directly inserted into the electronic card connector 1, a front end of the electronic card 92 would not contact the first contact portion 43 of the detecting terminal 4 in the rearward extending space 34 but would abut against the baffle wall 22. Because the first contact portion 43 does not contact the electronic card 92 or the carriage 93, it may avoid the first contact portion 43 from scraping, so as to ensure good conductivity of the first contact portion 43.

Figure 11:
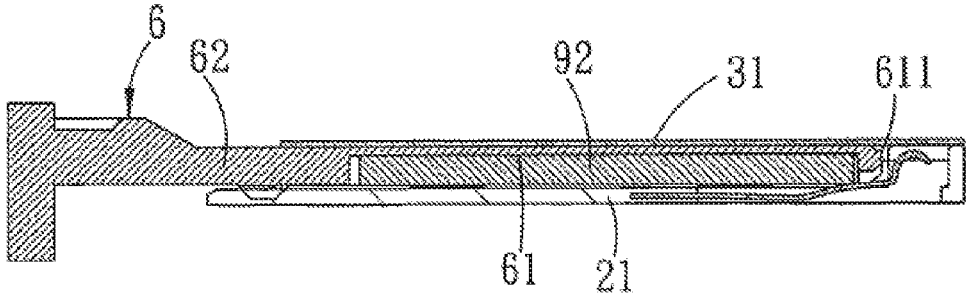
FIG. 11 is a sectional view along a XI-XI line of FIG. 8.

Referring to FIG. 11, when the electronic card 92 engaged with the carriage 6 is inserted into the insertion slot 33 and reaches a prescribed position, a front end 611 of the carriage 6 would not contact the first contact portion 43 of the detecting terminal 4 in the rearward extending space 34 but would abut against the baffle wall 22, and the first resilient arm portion 42 of the detecting terminal 4 would move toward the inside of the body 21 due to compression by the carrying portion 61 and the electronic card 92, and therefore the first contact portion 43 moves away from the base wall 31 of the cage 3 so as to disconnect a circuit, by which a state that the electronic card 92 has been inserted may be detected (or a power supply may be switch on). When the electronic card 92 and the carriage 6 are withdrawn from the insertion slot 33, the first resilient arm portion 42 immediately returns to an original position thereof so that the first contact portion 43 and the cage 3 are electrically connected, by which a state that the electronic card 92 is not inserted may be detected (or the power supply may be switch off).

Figure 12:
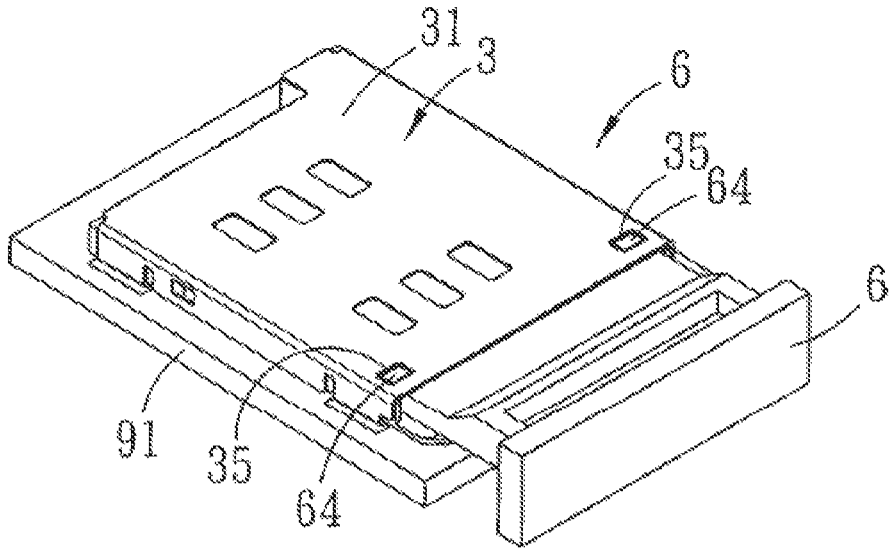
FIG. 12 is a perspective view that illustrates another embodiment of an assembly relationship among an electrical connection device, an electronic card, and a circuit board.
Figure 13:
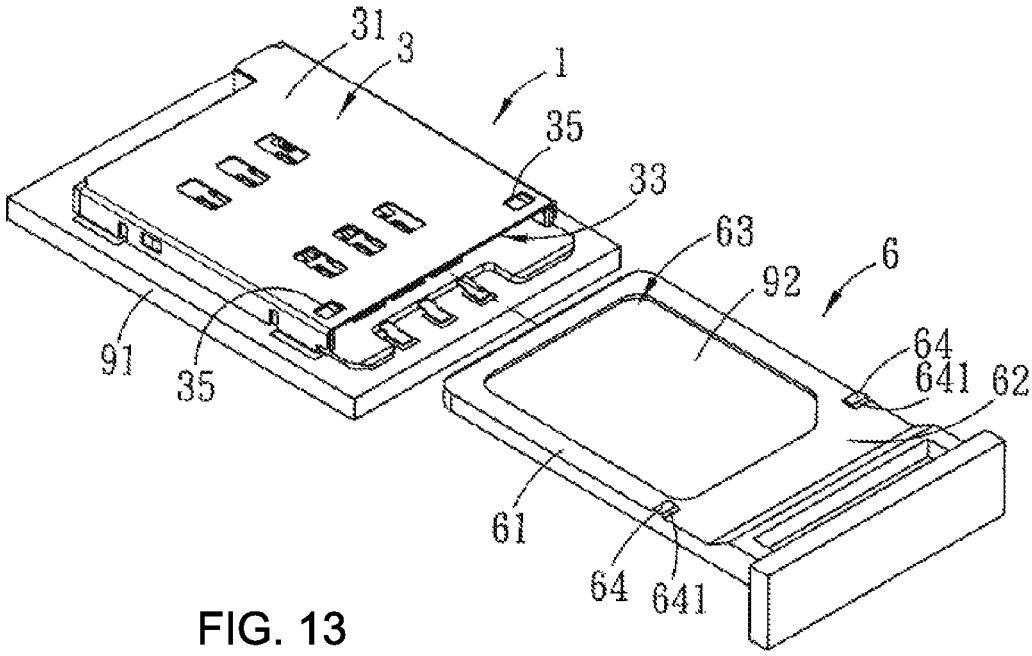
FIG. 13 is a perspective view of the electrical connector and a carriage of FIG. 12.

Referring to FIG. 12 and FIG. 13, an electrical connection device of a second preferred embodiment of the present invention is generally same as that of the first preferred embodiment. In the first preferred embodiment, the clamping slots 26 of the housing 2 are mated with the clamping blocks 64 of the carriage 6; however in the second preferred embodiment, clamping holes 35 of the cage 3 are mated with the clamping blocks 64 of the carriage 6. That is to say, in the second preferred embodiment, the cage 3 further comprises two clamping holes 35 provided close to a front end of the base wall 31 in the base wall 31, a position of the clamping block 64 of the carriage 6 is located at one side of the clamping connection portion 62 corresponding to the base wall 31 of the cage 3. Similarly, by clampingly connecting the clamping holes 35 to the clamping blocks 64, the carriage 6 may be releasably held to the electrical connector 1. Moreover, in the second preferred embodiment, each clamping slot 64 also has two guiding surfaces 641 located at two opposite sides along the slide-connecting direction, thereby the clamping blocks 64 is easily disengaged with the clamping holes 35.

In certain embodiments, therefore, by a fact that the first contact portion 43 of the detecting terminal 4 is located in the rearward extending space 34 behind the baffle wall 22, the electrical connector 1 is capable of avoiding the first contact portion 43 from contacting the electronic card 92 or the carriage 93 and avoiding the first contact portion 43 from scraping, so as to ensure good conductivity of the first contact portion 43. conclusion. In other embodiments, by clampingly connecting the clamping slots 26, which is provided in the region that the body 21 extends correspondingly to the length of the second soldering portion 54, to the clamping blocks 64 of the carriage 6, the carriage 6 may be held to the electrical connector 1, the volume of the electrical connector 1 would not be increased and the strength of the housing 2 would not be damaged. Or, by clampingly connecting the clamping holes 35 of the cage 3 to the clamping blocks 64 of the carriage 6, it may be also realized to the effect that the carriage 6 is held to the electrical connector 1 and the volume of the electrical connector 1 is not increased.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An electrical connection device comprising:

an electrical connector that includes:

a housing having a body with a front end and a clamping slot provided close to the front end;

a cage sheathed on the housing and defining, together with the housing, an insertion slot with an opening aligned with the front end; and a plurality of terminals provided in the body; and a carriage slidably engaging the insertion slot, the carriage having a clamping block mating with the clamping slot, the carriage unbreakingly releasably held to the electrical connector by clampingly connecting the clamping slot to the clamping block.

2. The electrical connection device according to claim 1, wherein the housing comprises two clamping slots respectively provided at two sides close to the front end in the body and the carriage has two clamping blocks respectively mating with the clamping slots.

3. The electrical connection device according to claim 2, wherein the clamping block of the carriage has two guiding surfaces located at two opposite sides along a slide-connecting direction.

4. The electrical connection device according to claim 3, wherein the carriage further includes a carrying portion, a clamping connection portion and an accommodating groove provided in the carrying portion so as to accommodate an electronic card, wherein, in operation, the clamping blocks are provided in the clamping connection portion by inserting the carrying portion into the insertion slot and clampingly connecting the clamping blocks to the clamping slots of the housing each other and a electronic card is electrically connected to the terminals of the electrical connector.

5. An electrical connection device, comprising:

an electrical connector including a housing, a cage sheathed on the housing, the cage including a base wall with a front end and two opposite side walls and a clamping hole provided close to the front end, and a plurality of terminals provided in the housing, wherein the housing and cage define an insertion slot that has an opening aligned with the front end; and a carriage slideably positioned in the insertion slot, the carriage including a clamping block mating with the clamping hole, the clamping block having two guiding surfaces located at two opposite sides, the guiding surfaces orientated in a direction that the carriage is slid into the insertion slot, wherein the carriage unbreakably is releasably held to the electrical connector by clampingly connecting the clamping hole to the clamping block.

6. The electrical connection device according to claim 5, wherein the cage includes two clamping holes respectively provided at two sides close to the front end in the base wall and the carriage has two clamping blocks respectively mating with the clamping holes.

7. The electrical connection device according to claim 6, wherein the carriage further includes a carrying portion, a clamping connection portion, and an accommodating groove provided in the carrying portion so as to accommodate an electronic card, wherein, in operation, when the clamping blocks are provided in the clamping connection portion the electronic card is electrically connected to the terminals of the electrical connector.

8. An electrical connector comprising:

a housing with a baffle wall;

a cage sheathed on the housing and defining, together with the housing, a card inserting space in front of the baffle wall and a rearward extending space which is located behind the baffle wall and is in communication with the card inserting space;

a plurality of signal terminals provided in the housing; and a detecting terminal supported by the housing, the detecting terminal having a first fixing portion fixedly provided on the housing and located in front of the baffle wall, the detecting terminal further including a first resilient arm portion extending rearwards and upwards from the first fixing portion toward the rearward extending space, a first contact portion located in the rearward extending space behind the baffle wall, connected to a distal end of the first resilient arm portion and configured to contacting the cage and a first soldering portion extending out of the housing from the first fixing portion.

9. The electrical connector according to claim 8, wherein the first resilient arm portion includes a slow ascending segment connected to the first fixing portion and a steep ascending segment located behind the baffle wall and connected to the slow ascending segment and the first contact portion.

10. The electrical connector according to claim 9, wherein the signal terminals respectively have a second contact portion which is located in the card inserting space.

11. The electrical connector according to claim 10, wherein the signal terminals further include a second fixing portion located in front of the baffle wall and a second resilient arm portion extending from the second fixing portion, the second resilient arm portion having a distal end that is connected to the second contact portion and a second soldering portion extending out of the insulating base from the second fixing portion.

* * * * *